United States Patent [19]

Kochendorfer et al.

[11] 4,086,785

[45] May 2, 1978

[54] TWO-PIECE FAN MOTOR MOUNTING ARRANGEMENT

[75] Inventors: Donald P. Kochendorfer; Robert S. Hanson, both of Dayton, Ohio

[73] Assignee: General Motors Corporation, Detroit, Mich.

[21] Appl. No.: 760,154

[22] Filed: Jan. 17, 1977

[51] Int. Cl.[2] ..... F25D 17/06; F25D 11/02; F16F 15/00

[52] U.S. Cl. ..... 62/414; 62/419; 62/441; 248/15

[58] Field of Search ..... 62/414, 419, 441; 248/15, 22; 310/51

[56] References Cited

U.S. PATENT DOCUMENTS

| | | | |
|---|---|---|---|
| 3,280,583 | 10/1966 | Jones et al. | 62/414 |
| 3,599,442 | 8/1971 | Hanson | 62/441 |
| 3,941,339 | 3/1976 | McCarty | 248/15 |

*Primary Examiner*—Lloyd L. King
*Attorney, Agent, or Firm*—Edward P. Barthel

[57] ABSTRACT

A two-piece electric fan motor mounting arrangement for use in a domestic refrigerator cabinet which is designed to provide improved dampening of motor torque vibrations while allowing for easy assembly by reducing the number of parts. The mount includes a blower orifice housing and a U-shaped bracket, each molded of plastic, with the result that the mount has no effect on the motor magnetic flux path, thus permitting more efficient motor performance at the designed R.P.M. of the fan impeller while eliminating the requirement for electrical grounding.

4 Claims, 9 Drawing Figures

TWO-PIECE FAN MOTOR MOUNTING ARRANGEMENT

This invention relates to an improved electric fan motor mounting arrangement for use in driving an impeller or blower wheel for a cooling air distribution system of a domestic refrigerator, and more specifically to provide an improved motor mounting arrangement that effectively dampens and isolates torque vibrations imposed on the refrigerator.

The fan motor mounting arrangements used in prior art appliances, such as refrigerator air moving systems, have heretofore employed metal brackets to mount the fan motor and blower wheel assemblies in the evaporator compartment. The installation of such assemblies in a refrigerator cabinet has a low installation efficiency because of the number of parts required to meet electrical codes while requiring the need for additional metal clamping parts to achieve reduced vibration and noise levels. As example, metal carrying brackets are required by electrical codes to be grounded while the motor electrical wires must have approved routing provisions acceptable to Underwriters Laboratory. Further, the vibrations due to rotating parts requires dampening and isolation not only to eliminate undesirable noise but also to reduce fatigue of the securing members. To achieve a satisfactory service life, metal parts used in these applications require some form of corrosion protection. It has been determined that metal mounting brackets cause a reduction in the motor's R.P.M. resulting from the interference of the metal brackets on the magnetic flux field of the motor coil.

It is therefore an object of the present invention to provide an improved electric motor two-piece mounting arrangement for an appliance impeller allowing for easy assembly by reducing the number of parts while the motor torque imposed on the appliance are substantially reduced.

It is another object of the present invention to provide an improved two-piece refrigerator electric fan motor mounting assembly which employs an all-plastic integral fan housing orifice plate and interlocking U-shaped motor mounting clamp providing improved vibration damping and simplified assembly.

It is a further object of the present invention to provide an improved all-plastic integral fan housing flow orifice support plate and motor clamping arrangement which reduces the effect on the motor magnetic flux path, thereby permitting a more efficient motor performance at the required R.P.M. for the fan impeller.

Further objects and advantages of the present invention will be apparent from the following description, reference being had to the accompanying drawings wherein a preferred embodiment of the present invention is clearly shown.

Figure 1:
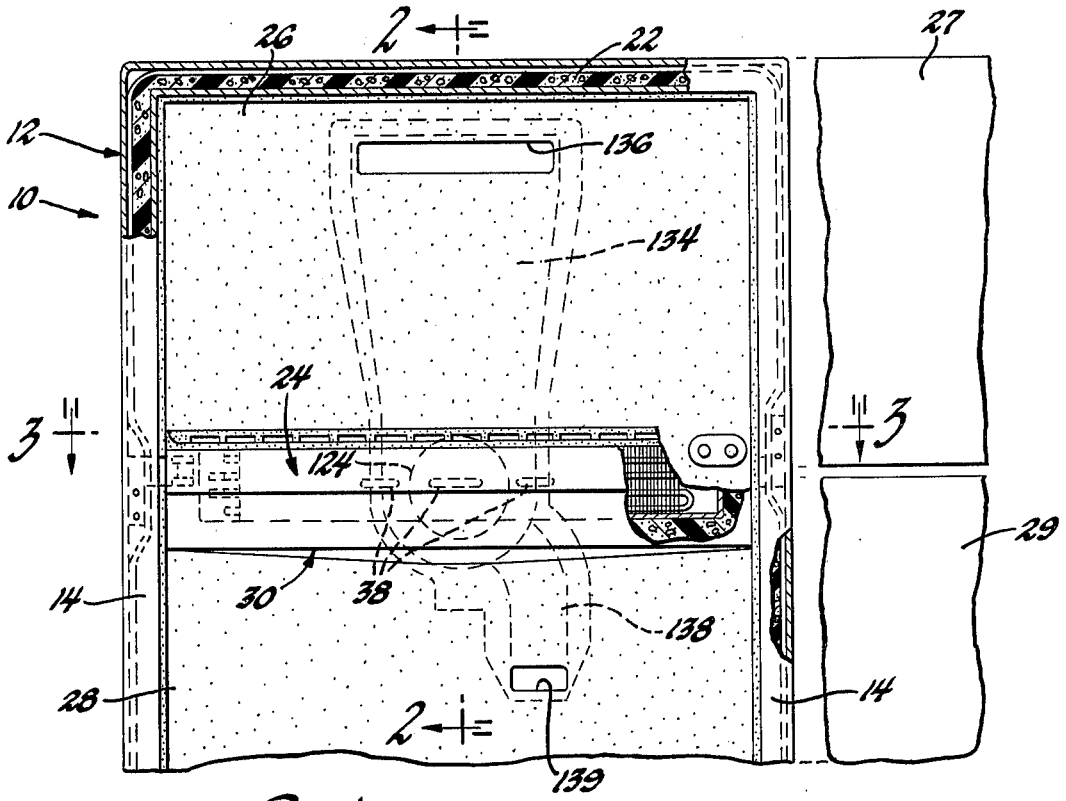
FIG. 1 is a fragmentary front elevational view, partly in section, of a domestic refrigerator embodying one form of the present invention.
Figure 2:
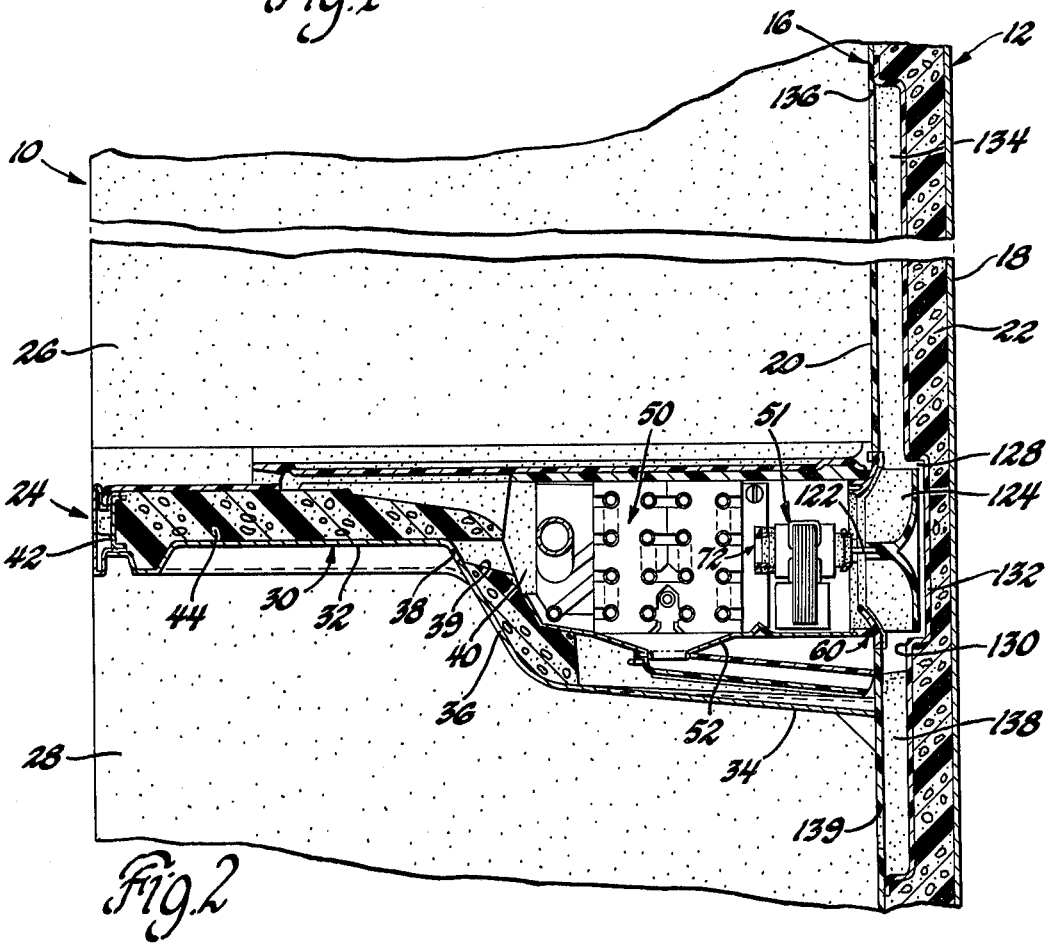
FIG. 2 is a fragmentary horizontal sectional view taken through the dividing wall along the line 2—2 of FIG. 1.
Figure 3:
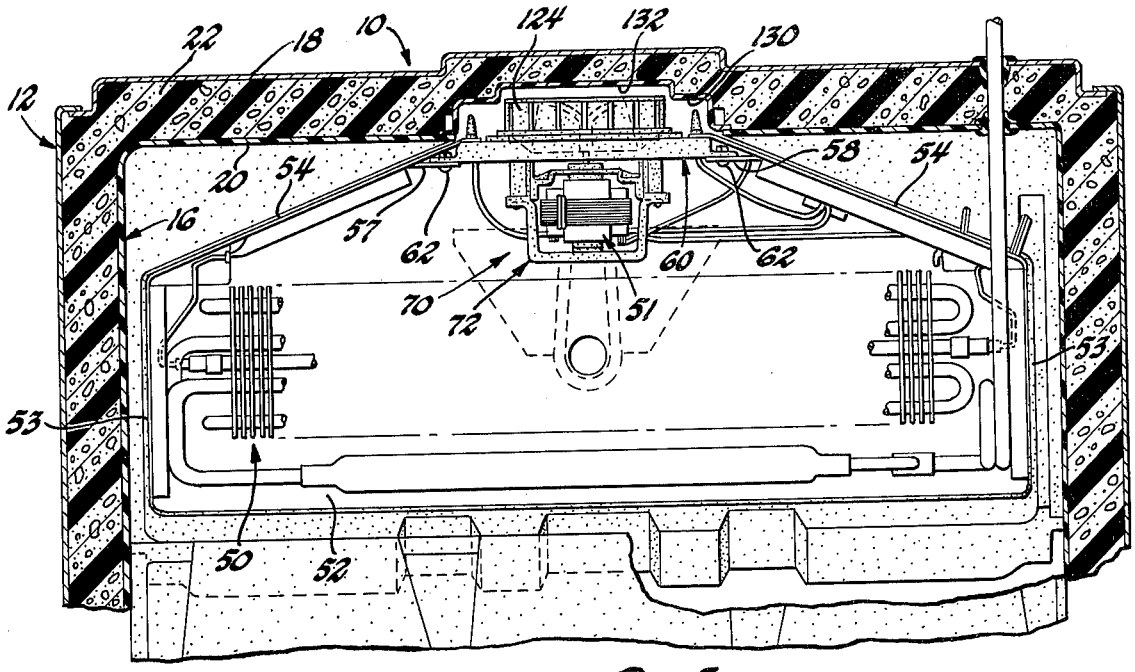
FIG. 3 is a fragmentary horizontal sectional view taken through the dividing wall along the line 3—3 of FIG. 1.

Referring now to the drawings and more particularly to FIGS. 1–3, there is illustrated a refrigerator cabinet upper portion 10 including an outer metal shell 12 having inturned front flanges 14 extending around a front access opening of the shell. Within the outer shell 12 is a one-piece plastic inner liner 16 having a bottom wall (not shown) over a machinery compartment including a motor compressor and condenser shown and described in U.S. Pat. No. 3,599,442 to Hanson, assigned to the same assignee. The inner liner 16 and outer shell 12 includes spaced rear walls 18 and 20 with plastic foam insulation 22, containing an insulating gas, being provided between the liner shell 12 in a conventional manner.

The inner liner 16 has a horizontally extending partition assembly or dividing means 24 forming an upper freezer compartment 26, closed by door 27, maintained at below-freezing temperatures between about 0° and 10° F. and a lower above-freezing compartment 28, closed by door 29, maintained at above-freezing temperatures of about 36° F. The top wall of the lower fresh food compartment is provided by a sheet metal wall 30 forming the bottom of the dividing means. The wall 30 includes a higher portion 32 of the front and a lower portion 34 at the rear with a slanted connecting section 36 in between the front and rear portions provided with air inlets 38 and 39 to an evaporator compartment 40 above. The wall 30 is supported at the rear by plastic supports (not shown) of glass fibers and high temperature thermo-plastics such as polyester. The wall is supported at the front by a transverse metal cross member 42 extending between the inturned flanges 14 of the outer shell 12.

Resting upon the lower portion 34 is a cast foam insulation piece 44 supporting a unitary removable cooling assembly 50, including a fan or blower motor 51, in which a drain pan 52 serves as a supporting frame and extends beneath substantially the entire unit. As seen in FIG. 2, the drain pan 52 is curved upwardly at the edges and at the sides and rear providing upwardly extending side and rear walls 53 and 54. At the center rear of the pan there is provided a pair of drain pan supporting flange gussets 57 and 58 to which is connected a plastic fan blower wheel housing, generally indicated at 60. The housing 60 secured to the drain pan in a vertical or upright plane parallel with the liner rear wall 20 by means of suitable sheet metal screws 62 extending through holes in each flange gusset 57 and 58 and aligned apertures 64 (FIG. 7) in integral side flanges 67 and 68 of the housing so as to abut the rearward surfaces of the gussets 57 and 58, respectively.

Figure 4:
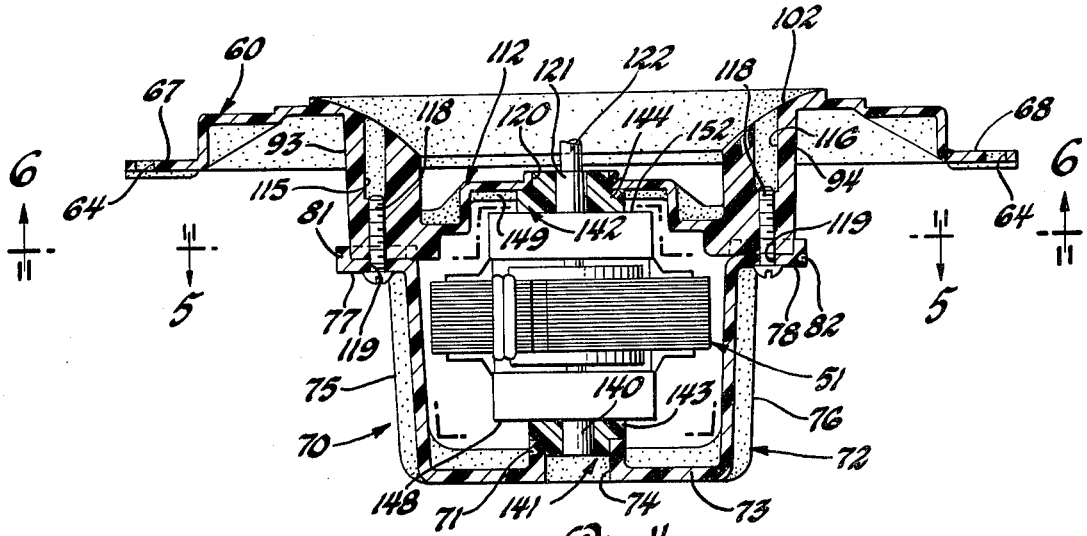
FIG. 4 is an enlarged sectional view of the motor mount of FIG. 3, showing details of the construction.

As best seen in FIGS. 3 and 4, the plastic blower housing forms the first part of a two-piece fan motor and blower wheel mounting assembly, generally indicated at 70, which includes the housing 60 and a fan motor shaft mounting bracket or clamp 72. The mounting bracket 72 is an integrally molded plastic U-shaped member including a base or bight portion 73 having a cylindrical base collar 71 defining an aperture 74 formed therein.

The U-shaped mounting bracket 72 further includes leg portions 75 and 76 extending rearwardly from the base 73 on either side of the fan motor 51 with the legs 75 and 76 terminating in outwardly directed foot portions 77 and 78, respectively.

Figure 7A:
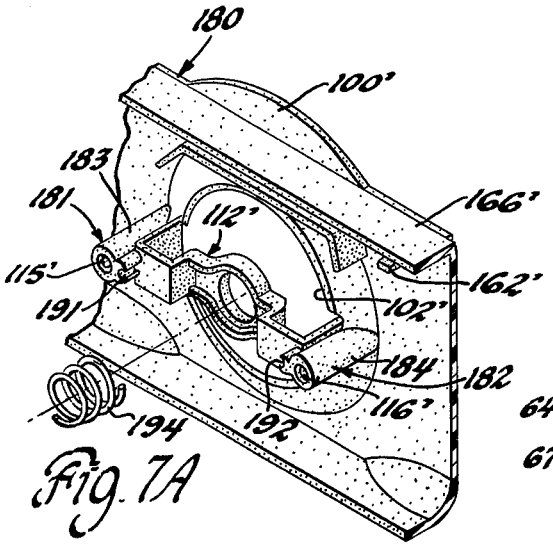
FIG. 7A is a fragmentary perspective view showing details of the alternate embodiment of FIG. 5A.
Figure 7:
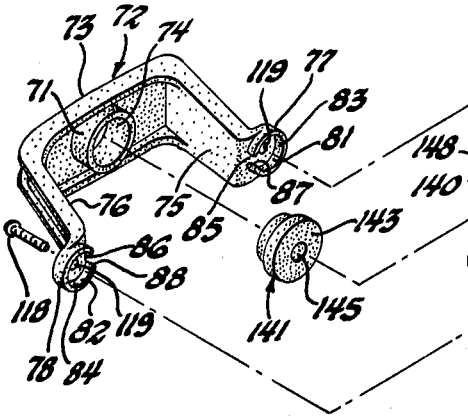
FIG. 7 is an exploded perspective view showing the details of the preferred embodiment of the motor mounting arrangement.
Figure 7:
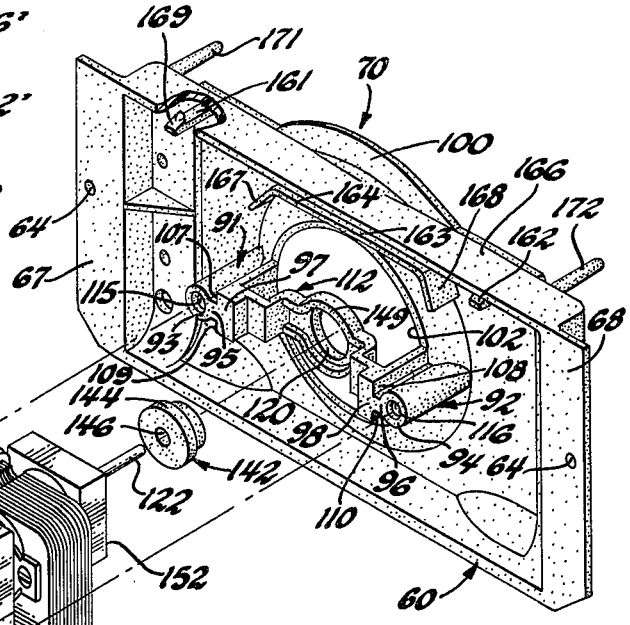

As best seen in FIG. 7, each of the foot portions 77, 78 are preferably semi-circular in configuration having C-sectioned complementary skirts 81 and 82, respectively extending outwardly from the bracket molded on the rearward face thereof with the C-section skirts 81, 82 defining inner sockets or cavities 83 and 84, respectively. The collars have diametrically opposed entrances or openings 85 and 86 defining paired shoulders 87 and 88. The openings 85, 86 are of a predetermined dimension to permit the sockets 83, 84 to telescopically receive the distal end of near-cylindrical composite bosses 91 and 92 having post-like portions 93 and 94, and an integral key-like portion in the form of T-stem portions 95 and 96 and T-head portions 97 and 98 respectively, integrally molded on housing plate 60.

With reference to FIG. 7, it will be seen that the composite bosses 91 and 92 extend forwardly from the housing plate 60 by virtue of their proximal ends being integrally molded on the inner surface of the plate concavo-convex portion forming a forward converging bell mouth 100 having a flow orifice 102. It will be noted in FIG. 6 that the composite bosses 91 and 92 are oriented in a symmetrical manner on the transverse axis 104 of the bell mouth orifice 102. Expressed differently, the composite bosses 91 and 92 are arranged in complemental mirror image relation with their inner transverse T-head portions 97 and 98 in diametrically opposed relation. Thus, the composite bosses 91 and 92, having a generally overall bulb-T cross-section, define upper 107, 108 and lower 109 and 110 longitudinally extending paired groove portions, respectively. It will be noted that the posts 93 and 94 have axial bores 115 and 116 formed therein for reception of machine screws 118.

As best seen in FIG. 7, a transverse integral bridge member 112 extends between the T-head portions 97 and 98. The bridge member has a circular aperture 120 formed therein coaxially aligned with the circular aperture 74 of bracket 72 drive shaft of a fan motor generally indicated at 51 in FIG. 7. The motor 51 employed in conjunction with the present invention is arranged horizontally and includes a rearwardly extending motor housing rear hub 121 aligned on the principal axis of motor drive shaft 122 rotatable within the fixed rear hub 121. FIG. 2 shows motor shaft 122 supporting a center inlet centrifugal blower wheel or impeller 124. Located in the insulation 22 of the rear wall 20 is a plastic duct 130 including a central scroll section 132 surrounding the impeller 124 and a wide upwardly extending duct portion 134 extending through an upper outlet 136 in the rear wall 20 of the plastic liner through which the air from the impeller is discharged into the upper freezer compartment 26. A downwardly extending duct portion 138 extends through a smaller outlet 139 for the discharge of air into the lower above-freezing or food storage compartment 28. The air flow arrangement for the refrigerator is conventional with the details thereof shown and discussed in the above-mentioned Hanson U.S. Pat. No. 3,599,442.

Figure 5:
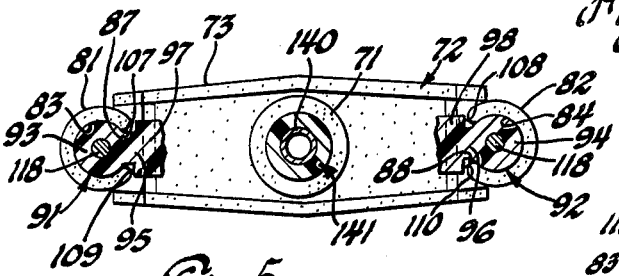
FIG. 5 is a cross-sectional detail of the motor mount showing the interconnection of the fan housing orifice and motor mounting bracket taken along the line 5—5 of FIG. 4.
Figure 6:
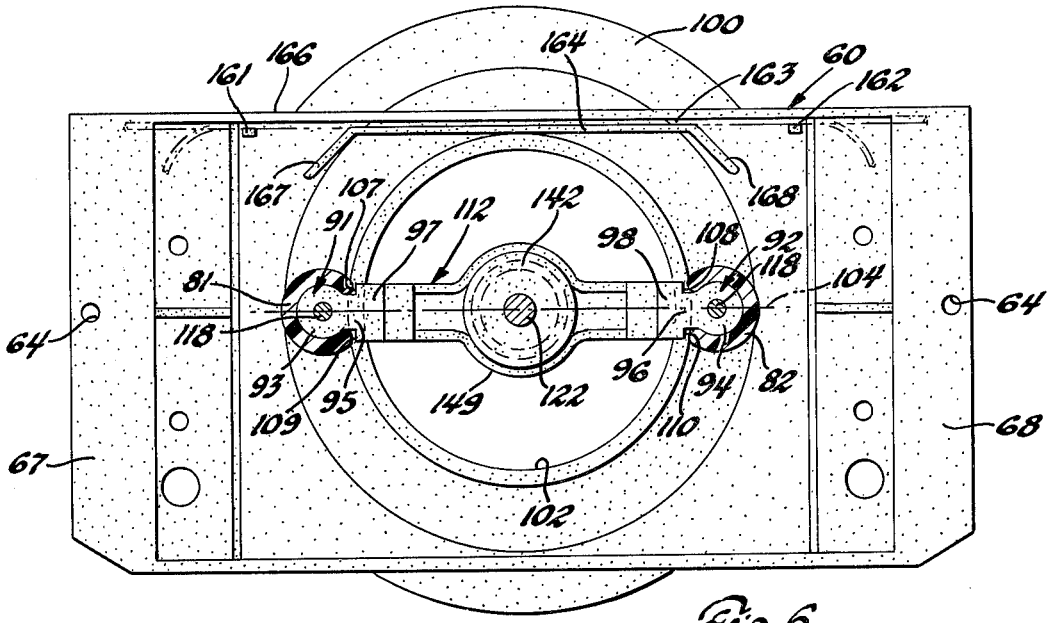
FIG. 6 is an enlarged detail of the fan housing orifice mounting plate and a portion of the interlocking mounting bracket taken along the line 6—6 of FIG. 4.

It will be seen in FIGS. 5 and 6 that the skirt openings 85 and 86 are dimensioned to receive their associated T-stem portions 95 and 96 to provide a torque receiving inner lock fit therebetween. Thus, upon suitable fastening means, such as the machine screws shown at 118, being inserted through holes 119 in the foot portions 77 and 78 and threaded into the post bores 115 and 116 the U-shaped motor mounting bracket 72 is rigidly secured to the fan housing orifice plate 60 to resiliently support the fan motor shaft 122 in a substantially horizontal position. In this manner applicants' motor mounting arrangement insures against lateral movement of the shaft 122 and blower wheel 124 relative to the orifice 102. It is a requirement that such movement be obviated to prevent the edge of the blower wheel 124 from contacting the housing orifice and producing undesirable noise or vibration and possible damage to the contacting parts.

As best seen in FIGS. 4 and 7, applicants' molded two-piece plastic motor mounting arrangement includes a resilient means associated with the housing bridge opening 120 and bracket base opening for supporting the rear hub 121, concentrically surrounding the rearwardly extending motor drive shaft 122, and the forwardly extending motor front hub 140. In the embodiment of FIGS. 1-7 the resilient means for mounting the motor 51 and impeller 124 assembly includes resilient front and rear mounting blocks or grommets 141 and 142 respectively, which are preferably made of soft material such as soft rubber to better attenuate noise and vibration. The identical front 141 and rear 142 grommets are arranged with their thickened or cap end portions 143 and 144 in opposed relation for contacting the motor 51. When the mount is assembled the resilient grommets provide axial aligned holes 145 and 146 which encompass and grip the motor front and rear hubs 140 and 121, respectively.

Upon insertion of the front grommet 141 into bracket opening 74 the bracket accommodates the motor housing front hub 140, which is of sufficient length to extend through grommet hole 145, with its cap end 143 positioned between the cylindrical edge of base collar 71 and the forward face 148 of the motor. The rear grommet cap 144 extends beyond peripheral ribs 149 of the bridge 112 for abutment with the rearward motor face 152. In this way the motor 51 is resiliently clamped between the two grommets 141 and 142 and is free for a limited torsional movement in order to diminish noise and dampen vibration.

Thus, when the bracket sockets 83, 84 are aligned and placed over the distal ends of the post portions 93, 94, registry will be obtained between openings 85, 86 (FIG. 7) and T-stem portions 95, 96; between the paired shoulders 87 of skirt 81 and groove portions 107 and 109; between paired shoulders 88 of skirt 82 and groove portions 108 and 110; and between the arcuate sockets 83 and 84 which substantially encircle the distal ends of posts 93, 94. As a consequence, the motor 51 may be resiliently mounted between the bracket and housing and the entire assembly releasably clamped together by means of the two screws 118 as shown in FIG. 4.

As seen in FIGS. 6 and 7, applicants' improved motor mount includes integrally molded flexible electrical lead or wire clips 161 and 162 with a wire routing channel 163 formed between integral routing rib 164 extending parallel to and a defined distance from forwardly extending housing top flange 166. It will be noted that the rib 164 includes integral downwardly inclined lead-in portions 167 and 168 to facilitate the placement of wires, shown in phantom, in the channel 163. As seen in FIG. 7, the clips 161 and 162 have enlarged end notched portions with their upper lead-in surfaces being dimpled to protect the electrical insulation as shown at 169 for clip 161, to insure releasable retention of the electrical wires in the housing. The orifice housing 60 further includes integral locating prongs 171 and 172 extending rearwardly for reception in suitable aligning holes in the cabinet rear wall.

Figure 5A:
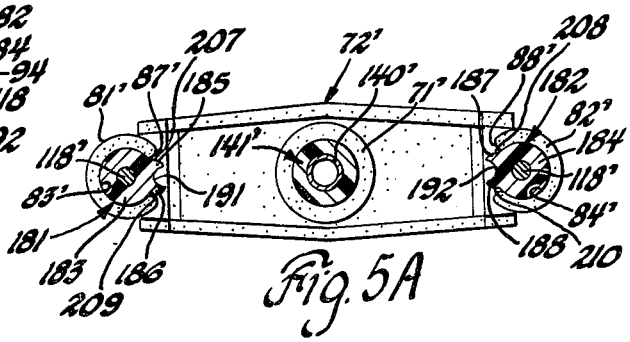
FIG. 5A is a view similar to FIG. 5 showing alternate embodiment.

FIGS. 5A and 7A disclose a modified motor mount orifice housing 180 and U-shaped bracket 72' wherein parts identical with the orifice housing 60 and bracket 72 in FIGS. 1–7 are shown with corresponding primed numerals. The modified orifice housing shows composite bosses 181 and 182 having post-like portions 183 and 184 and integral key-like portions in the form of lobed portions. The lobe portions of the composite bosses 181 and 182 are separated into paired flutes 185, 186 and 187, 188, respectively by opposed radiused-out portions 191 and 192, respectively. It will be seen that the composite bosses 181 and 182 fluted extensions 185, 186 and 187, 188 each define upper 207, 208 and lower 209 and 210 longitudinally extending mirror image grooves or cusps similar to the grooves 107–110 of the first embodiment. Thus, the composite bosses 181 and 182 have a generally overall bulb-lobe cross-section with the paired grooves 207, 208 and 209, 210 telescopically receiving their associated paired shoulders 87' and 88' of U-shaped bracket 72', as seen in FIG. 5A, to provide an axially slidable, removable interlocking connection.

It will be noted that the resilient mounting means for motor 51 may be in the form of helical compression springs, as shown by rear spring 194 for example, in FIG. 7A. Thus, under appropriate conditions, helical compression springs may be substituted for the resilient grommets 141 and 142 of the embodiment of FIGS. 1–7 or the resilient grommets of the embodiment of FIGS. 5A and 7A as shown by grommet 141' in FIG. 5A. without departing from the scope of applicants' invention.

While the embodiment of the present invention as herein disclosed constitutes a preferred form, it is to be understood that other forms might be adopted.

We claim:

1. A two-piece mounting arrangement for supporting a fan motor on an appliance wall, said fan motor having a rotatable shaft disposed in a substantially horizontal position, an impeller supported on said shaft, first and second oppositely extending motor mounting hubs aligned on the axis of said motor shaft, said two-piece mounting arrangement comprising; a first piece in the form of a fan housing orifice molded plastic plate member having a central impeller orifice formed therein, means for supporting said plate member on the appliance wall, said plate member having a pair of integral composite bosses oriented on the transverse axis of the orifice and extending in one direction with their proximal ends molded to one face of said plate member, said bosses each having a post-like portion and an integral key-like portion, the key-like portions of said bosses being symmetrically oriented on said transverse axis in diametrically opposed inwardly facing mirror image relation, said composite bosses each defining at the juncture of their post-like portions and key-like portions longitudinally extending paired grooves symmetrically positioned on either side thereof, a transverse integral bridge member extending between said composite bosses, said bridge member having an aperture formed therein located in substantial coaxial relation with the fan motor hubs, the second mounting piece in the form of an integrally molded plastic U-shaped motor mounting clamp, said clamp including a base portion having an aperture aligned with the aperture in said bridge, resilient grommets located within the bridge and base apertures, providing aligned holes receiving and gripping the motor first and second hubs, respectively, for resiliently supporting said motor therebetween; said U-shaped mounting clamp including leg portions extending in the opposite direction to said bosses on either side of the fan motor shaft and terminating in outwardly directed foot portions having C-sectioned complementary collars integrally molded on the underside thereof, said C-sectioned collars defining inner cavities and diametrically opposed entrances of a dimension to permit telescopic reception of the distal end of the composite bosses, each collar entrance defining a pair of shoulder portions adapted to be slidably received in the pair of grooves of its associated boss, wherein each collar entrance receives its associated composite boss key-like portion therein with its pair of collar shoulders providing a torque receiving interlock fit with their related grooves, and fastening means extending axially from each foot portion into its interlocked composite boss post-like portion, whereby said U-shaped motor mounting bracket is rigidly secured to said plate member mounting bosses to resiliently support the fan motor on the appliance wall.

2. In a refrigerator including a cabinet having an outer shell and an inner liner enclosing a compartment, a dividing means within said inner liner dividing said compartment into subcompartments, a pan having upwardly extending side walls and rear walls, a refrigerant evaporator supported by said pan and a fan and fan motor shaft for circulating air from the evaporator to the subcompartments, first and second oppositely extending motor mounting hubs aligned on the axis of said motor shaft, the improvement including a two-piece fan housing orifice place member and fan motor mounting clamp assembly supported upon said pan between said evaporator and said inner liner, said first piece in the form of a molded plastic plate member having a central bell mouth converging orifice, said plate member having a pair of integral first and second composite mounting bosses oriented on the transverse axis of said orifice and extending in one direction with their proximal ends molded to the inner face of said bell mouth orifice, said bosses having a generally bulb-T section symmetrically oriented on said transverse axis with their T-head portions aligned in diametrically opposed relation on the periphery of said bell mouth orifice, the bulb portions of said bosses each defining near circular post-like supports, a transverse integral bridge member extending between said T-head portions, said bridge member having an aperture formed therein located in substantial coaxial relation with the fan motor shaft and hubs, said first hub shaft extending through said bridge aperture in a manner to locate said fan in said bell mouth orifice, said second piece in the form of an integrally molded plastic U-shaped motor shaft mounting clamp, said clamp including a base portion having an aperture aligned with said bridge aperture, means associated with said bridge and base apertures for resiliently supporting said motor first and second hubs respectively, said U-shaped mounting clamp including leg portions extending in the opposite direction to said bosses on either side of the fan motor shaft and terminating in outwardly directed foot portions having C-sectioned complementary collars molded on the underside thereof, said C-sectioned collars having their inner cavities and opposed entrances of a dimension to permit a telescopic reception of the distal end of the post-like supports and the adjacent T-stems of said bosses wherein the collar entrances abut the outboard surface of said T-heads to provide a torque receiving interlock fit therebetween, and a fastening means extending axially from the foot portion into the post-like supports whereby said U-shaped motor mounting bracket is rigidly secured to said plate member mounting bosses to resiliently support the fan motor on the refrigerator pan.

3. In a refrigerator including a cabinet having an outer shell and an inner liner enclosing a compartment, a dividing means within said inner liner dividing said compartment into subcompartments, a pan having upwardly extending side walls and rear walls, a refrigerant evaporator supported by said pan and a fan and fan motor shaft for circulating air from the evaporator to the subcompartments, the improvement including a two-piece fan housing orifice and fan motor shaft mounting assembly supported upon said pan between said evaporator and said inner liner, said first piece in the form of a molded plastic plate member having a central bell mouth converging orifice, said plate member having a pair of integral first and second composite mounting bosses oriented on the transverse axis of said orifice and extending in one direction with their proximal ends molded to the inner face of said bell mouth orifice, said bosses having a generally bulb-lobe section symmetrically oriented on said transverse axis with their lobed portions aligned in diametrically opposed relation on the periphery of said bell mouth orifice, the bulb portions of said bosses each defining near circular post-like supports terminating in longitudinally extending paired cusps positioned on either side of its lobe portion, a transverse integral bridge member extending between said lobe portions, said bridge member having an aperture formed therein located in substantial coaxial relation with the fan motor shaft, the shaft extending through said bridge aperture in a manner to locate said fan in said bell mouth orifice, said second piece in the form of an integrally molded plastic U-shaped motor shaft mounting clamp, said clamp including a base portion having an aperture aligned with said bridge aperture, resilient means associated with said bridge and base apertures for supporting said motor shaft, said U-shaped mounting clamp including leg portions extending in the shaft and terminating in outwardly directed foot portions having C-sectioned complementary collars molded on the underside thereof, said C-sectioned collars having their inner cavities and opposed entrances of a dimension to permit a telescopic reception of the distal end of the composite bosses, each collar entrance defining a pair of shoulder portions adapted to be slidably received in the pairs of cusps of its associated boss, wherein each collar entrance receives its associated lobe portion with each pair of collar shoulders providing a torque receiving interlock fit with their related cusps, and fastening means extending axially from each foot portion into its interlocked boss, whereby said U-shaped motor mounting bracket is rigidly secured to said plate mounting bosses to resiliently support the fan motor shaft.

4. A two-piece mounting arrangement for supporting a fan motor on an appliance wall, said fan motor having a rotatable shaft disposed in a substantially horizontal position, an impeller supported on said shaft, first and second oppositely extending motor mounting hubs aligned on the axis of said motor shaft, said two-piece mounting arrangement comprising; a first piece in the form of a fan housing orifice molded plastic plate member having a central impeller orifice formed therein, means for supporting said plate member on the appliance wall, said plate member having a pair of integral composite bosses oriented on the transverse axis of the orifice and extending in one direction with their proximal ends molded to one face of said plate member, said bosses each having a post-like portion and an integral key-like lobe portion, the key-like lobe portions of said bosses being symmetrically oriented on said transverse axis in diametrically opposed inwardly facing mirror image relation, said composite bosses each defining at the cuspidal edge junctions of their post-like portions and key-like lobe portions longitudinally extending paired grooves symmetrically positioned on either side thereof, a transverse integral bridge member extending between said composite bosses, said bridge member having an aperture formed therein located in substantial coaxial relation with the fan motor hubs, the second mounting piece in the form of an integrally molded plastic U-shaped motor mounting clamp, said clamp including a base portion having an aperture aligned with the aperture in said bridge, resilient grommets located within the bridge and base apertures providing aligned holes receiving and gripping the motor first and second hubs, respectively, for resiliently supporting said motor therebetween; said U-shaped mounting clamp including leg portions extending in the opposite direction to said bosses on either side of the fan motor shaft and terminating in outwardly directed foot portions having C-sectioned complementary collars integrally molded on the underside thereof, said C-sectioned collars defining inner cavities and diametrically opposed entrances of a dimension to permit telescopic reception of the distal end of the composite bosses, each collar entrance defining a pair of shoulder portions adapted to be slidably received in the pair of grooves of its associated boss, wherein each collar entrance receives its associated composite boss key-like lobe portion therein with its pair of collar shoulders providing a torque receiving interlock fit with their related grooves, and fastening means extending axially from each foot portion into its interlocked composite boss port-like portion whereby said U-shaped motor mounting bracket is rigidly secured to said plate member mounting bosses to resiliently support the fan motor on the appliance wall.

* * * * *